US009242150B2

(12) United States Patent
Gale

(10) Patent No.: US 9,242,150 B2
(45) Date of Patent: Jan. 26, 2016

(54) SYSTEM AND METHOD FOR DETERMINING BALL MOVEMENT

(71) Applicant: Gregory W. Gale, Napa, CA (US)

(72) Inventor: Gregory W. Gale, Napa, CA (US)

(73) Assignee: Just Rule, LLC, Napa, CA (US)

( * ) Notice: Subject to any disclaimer, the term of this patent is extended or adjusted under 35 U.S.C. 154(b) by 0 days.

(21) Appl. No.: 14/201,271

(22) Filed: Mar. 7, 2014

(65) Prior Publication Data

US 2014/0256478 A1 Sep. 11, 2014

Related U.S. Application Data

(60) Provisional application No. 61/775,238, filed on Mar. 8, 2013.

(51) Int. Cl.
*A63B 43/00* (2006.01)
*A63B 71/06* (2006.01)
(Continued)

(52) U.S. Cl.
CPC ..... *A63B 43/004* (2013.01); *A63B 41/085* (2013.01); *A63B 63/008* (2013.01); *A63B 69/0013* (2013.01); *A63B 2024/0028* (2013.01); *A63B 2037/125* (2013.01); *A63B 2102/18* (2015.10); *A63B 2102/20* (2015.10); *A63B 2220/10* (2013.01); *A63B 2220/20* (2013.01); *A63B 2225/20* (2013.01);
(Continued)

(58) Field of Classification Search
CPC .... A63B 43/004; A63B 43/06; A63B 41/085; A63B 69/0002; A63B 69/002; A63B 2024/0028; A63B 2037/125; A63B 2220/10; A63B 2225/20; A63B 2225/50; A63B 2225/54; A63B 2243/0004; A63B 2243/0025; A63B 2243/007
See application file for complete search history.

(56) References Cited

U.S. PATENT DOCUMENTS 3,782,730 A 1/1974 Horchler
3,840,699 A 10/1974 Bowerman
(Continued)

FOREIGN PATENT DOCUMENTS

DE 101 43 588 3/2003
GB 2110545 6/1983
JP 6323852 11/1994

OTHER PUBLICATIONS

Fraunhofer Institute for Integrated Circuits, RedFIR® Precision Real-Time Tracking, 8 pages, Nurnberg, Germany.
TopGolf webpage, http://www.topgolf.co.uk, Jan. 24, 2004.

*Primary Examiner* — Steven Wong
(74) *Attorney, Agent, or Firm* — Boardman & Clark LLP

(57) ABSTRACT

A system for identifying ball movement and position is disclosed. The system includes a ball for use in a sport activity comprising a lace or thread on, or adjacent to, an outer surface of the ball, and a communication element such as a wire or antenna disposed within the lace or thread, the ball's communication element being adapted to communicate via a signal received from, or sent to, one or more communication elements, such as a transmitter or receiver, disposed at or near a playing area. The playing area communication elements are adapted to communicate ball position based upon the signals sent and/or received. A processor is provided which is adapted to translate or process information received by the playing area communication elements into position, trajectory and/or movement of the ball. A method of identifying ball movement, trajectory and position and a ball for use with a ball movement and position identification system are also disclosed.

13 Claims, 9 Drawing Sheets

(51) Int. Cl.

| | |
|---|---|
| ***A63B 63/00*** | (2006.01) |
| ***A63B 69/00*** | (2006.01) |
| ***A63B 41/08*** | (2006.01) |
| *A63B 24/00* | (2006.01) |
| *A63B 37/12* | (2006.01) |

(52) U.S. Cl.

CPC ..... *A63B 2225/50* (2013.01); *A63B 2225/54* (2013.01); *A63B 2243/007* (2013.01); *A63B 2243/0025* (2013.01); *A63B 2243/0095* (2013.01)

(56) References Cited

U.S. PATENT DOCUMENTS

| | | | | |
|---|---|---|---|---|
| 4,005,261 | A | 1/1977 | Sato et al. | |
| 4,071,242 | A * | 1/1978 | Supran | 473/570 |
| 4,150,825 | A | 4/1979 | Wilson | |
| 4,158,853 | A | 6/1979 | Sullivan et al. | |
| 4,160,942 | A | 7/1979 | Lynch et al. | |
| 4,437,672 | A | 3/1984 | Armantrout et al. | |
| 4,673,183 | A | 6/1987 | Trahan | |
| 4,675,816 | A | 6/1987 | Brandon et al. | |
| 4,696,474 | A | 9/1987 | Tegart | |
| 4,703,444 | A | 10/1987 | Storms, Jr. et al. | |
| 4,736,097 | A | 4/1988 | Philipp | |
| 4,828,267 | A | 5/1989 | Goodrich | |
| 4,893,182 | A | 1/1990 | Gautraud et al. | |
| 4,910,677 | A | 3/1990 | Remedio et al. | |
| 4,934,705 | A | 6/1990 | Shirley | |
| 4,951,137 | A | 8/1990 | Kisou et al. | |
| 5,083,800 | A | 1/1992 | Lockton | |
| 5,102,140 | A | 4/1992 | Vincent | |
| 5,111,410 | A | 5/1992 | Nakayama et al. | |
| 5,138,322 | A | 8/1992 | Nuttall | |
| 5,160,839 | A | 11/1992 | Nishiyama et al. | |
| 5,163,683 | A | 11/1992 | Oswald | |
| 5,210,603 | A | 5/1993 | Sabin | |
| 5,226,660 | A | 7/1993 | Curchod | |
| 5,290,037 | A | 3/1994 | Witler et al. | |
| 5,326,095 | A | 7/1994 | Dudley | |
| 5,342,051 | A | 8/1994 | Rankin et al. | |
| 5,364,093 | A | 11/1994 | Huston et al. | |
| 5,398,936 | A | 3/1995 | Kluttz et al. | |
| 5,413,345 | A | 5/1995 | Nauck | |
| 5,423,549 | A | 6/1995 | Englmeier | |
| 5,469,175 | A | 11/1995 | Boman | |
| 5,471,383 | A | 11/1995 | Gobush et al. | |
| 5,480,154 | A | 1/1996 | Barnhill | |
| 5,486,002 | A | 1/1996 | Witler et al. | |
| 5,489,099 | A | 2/1996 | Rankin et al. | |
| 5,491,486 | A | 2/1996 | Welles et al. | |
| 5,532,677 | A | 7/1996 | Miller | |
| 5,562,285 | A | 10/1996 | Anfinsen et al. | |
| 5,626,526 | A | 5/1997 | Pao et al. | |
| 5,626,531 | A | 5/1997 | Little | |
| 5,658,210 | A | 8/1997 | Cornell | |
| 5,685,504 | A | 11/1997 | Schneider et al. | |
| 5,700,204 | A | 12/1997 | Teder | |
| 5,743,815 | A | 4/1998 | Helderman | |
| 5,768,151 | A | 6/1998 | Lowy et al. | |
| 5,798,519 | A | 8/1998 | Vock et al. | |
| 5,810,680 | A | 9/1998 | Lobb et al. | |
| 5,868,578 | A | 2/1999 | Baum | |
| 6,042,492 | A | 3/2000 | Baum | |
| 6,093,923 | A | 7/2000 | Vock et al. | |
| 6,113,504 | A | 9/2000 | Kuesters | |
| 6,148,271 | A * | 11/2000 | Marinelli | 702/141 |
| 6,188,371 | B1 * | 2/2001 | Li et al. | 343/866 |
| 6,266,008 | B1 | 7/2001 | Huston et al. | |
| 6,320,173 | B1 | 11/2001 | Vock et al. | |
| 6,497,649 | B2 | 12/2002 | Parker et al. | |
| 6,524,199 | B2 | 2/2003 | Goldman | |
| 6,582,328 | B2 | 6/2003 | Kuta et al. | |
| 6,607,123 | B1 | 8/2003 | Jollifee et al. | |
| 6,634,959 | B2 | 10/2003 | Kuesters | |
| 6,824,480 | B2 | 11/2004 | John et al. | |
| 7,095,312 | B2 | 8/2006 | Erario et al. | |
| 7,815,525 | B2 | 10/2010 | Small | |
| 2002/0030625 | A1 | 3/2002 | Cavallaro et al. | |
| 2002/0165046 | A1 | 11/2002 | Helber | |
| 2002/0177490 | A1 | 11/2002 | Yong et al. | |
| 2003/0054905 | A1 | 3/2003 | King, Jr. | |
| 2003/0122657 | A1 | 7/2003 | Hodsdon et al. | |
| 2004/0142766 | A1 | 7/2004 | Savarese et al. | |
| 2004/0220001 | A1 * | 11/2004 | Oister et al. | 473/570 |
| 2005/0101411 | A1 | 5/2005 | Stiller et al. | |
| 2008/0122704 | A1 * | 5/2008 | King | 343/702 |
| 2011/0077112 | A1 * | 3/2011 | Erario et al. | 473/570 |
| 2011/0118062 | A1 * | 5/2011 | Krysiak et al. | 473/570 |
| 2011/0147462 | A1 * | 6/2011 | Speich | 235/492 |
| 2011/0267461 | A1 | 11/2011 | Birenboim et al. | |
| 2012/0256492 | A1 * | 10/2012 | Song et al. | 307/66 |
| 2013/0167290 | A1 * | 7/2013 | Ben Ezra | 2/425 |
| 2014/0128182 | A1 * | 5/2014 | Hohteri | 473/570 |
| 2014/0221137 | A1 * | 8/2014 | Krysiak et al. | 473/570 |

* cited by examiner

SYSTEM AND METHOD FOR DETERMINING BALL MOVEMENT

CROSS-REFERENCE TO RELATED APPLICATIONS

This application claims priority as a non-provisional application of U.S. provisional application Ser. No. 61/775,238, filed Mar. 8, 2013, entitled SYSTEM AND METHOD FOR DETERMINING BALL MOVEMENT, the contents of which is hereby incorporated by reference in its entirety.

FIELD

The present invention relates generally to devices, methods and systems in the field of tracking moving objects. More specifically, the present invention relates to devices, methods and systems for tracking attributes and/or movement and position of a ball used in a sports event.

BACKGROUND

Many sports are played on, in, within and/or around a defined sports playing area such as on, or around, a field or court, or in, or within, a gymnasium, arena or stadium. These sports frequently include a moving object, namely, a ball which is moved about, on or within the defined playing area. The ball is frequently moved in response to a force or action placed upon the ball and travels in a trajectory based upon the applied force and other environmental factors.

A variety of systems are currently available to track ball movement, trajectory and position in and on a playing area. For instance, many systems include multiple cameras which capture images or videos of ball movement, which images or videos are combined by computer implemented programs into an estimate of ball movement and trajectory. These systems are not precise and do not account for environmental factors. Moreover, these systems require a complex setup of multiple cameras at multiple angles in an attempt to capture the required data. Other systems include a GPS microprocessor embedded within the ball which communicates to appropriate receiving devices. Unfortunately, such devices affect the integrity of the ball and have not been accepted in practice as a result.

Systems also exist which allow broadcasters, and in particular television broadcasters, to project a computerized image onto the viewing screens of those who receive the broadcast. Common examples include the first down line that extends across the field during a United States football game, or a frame of an estimated strike zone in baseball, or an estimated trajectory of a homerun hit baseball. These systems are, however, not available in real time to the players or officials, and are, like the camera and video systems, merely an estimate based upon data gathered.

SUMMARY

According to a first exemplary aspect of the invention, a ball for use in a sport activity includes a lace and a communication element disposed inside of the lace. The communication element is adapted to communicate a signal.

In one exemplary embodiment, the ball includes an outer surface and a portion of the lace is disposed on the outer surface. The communication element is disposed inside of the portion of the lace which is disposed on the outer surface in this exemplary embodiment. In another exemplary embodiment, a portion of the lace is disposed adjacent to the outer surface and the communication element is disposed inside of the portion of the lace which is disposed adjacent to the outer surface.

In other exemplary embodiments, the ball communication element is a wire, an antenna, or an electrically conductive element. The communication element is inserted into the lace, is integrated into the lace, or is woven into the lace in other exemplary embodiments. The lace is comprised of a plurality of thread fibers and at least one of the thread fibers is the communication element in yet another exemplary embodiment. In another exemplary embodiment, the communication element is electrically conductive. The lace is the communication element in one other exemplary embodiment.

In one exemplary embodiment, the ball is selected from the group consisting of a baseball, a football, a soccer ball, a cricket ball, and a volley ball. The signal is an electrical signal or a magnetic signal in other exemplary embodiments. In one other exemplary embodiment, the ball includes a transmitter coupled to the communication element.

According to a second exemplary aspect of the invention, a system for identifying movement and position of balls on, in, within and/or around a sport playing area includes a ball and at least one playing area communication element positioned near the playing area. The ball has an outer surface, a lace disposed adjacent to the outer surface, and a ball communication element at least partially disposed inside of the lace. The ball communication element is adapted to communicate a signal. The at least one playing area communication element is adapted to communicate with the ball communication element via the signal.

In one exemplary embodiment, the at least one playing area communication element is a receiver adapted to receive the signal from the ball communication element. The ball includes a radio-frequency identification tag coupled to the ball communication element in another exemplary embodiment.

According to a third exemplary aspect of the invention, a system for identifying movement and position of balls on, in, within and/or around a sport playing area includes a ball, a playing area communication element positioned near the playing area, and a processor. The ball has an outer surface, a lace disposed adjacent to the outer surface, and a ball communication element at least partially disposed inside of the lace. The ball communication element is adapted to communicate a signal. The playing area communication element is adapted to communicate ball position based upon the signal received by the playing area communication element from the ball communication element. The processor is adapted to process ball position information received by the playing area communication element into position and movement of the ball.

According to a fourth exemplary aspect of the invention, a method of identifying movement and position of balls on, in, within and/or around a sport playing area includes placing a plurality of playing area communication elements near a playing area, determining a location of the ball, calculating movement of the ball and communicating the location and movement of the ball. The plurality of playing area communication elements are adapted to receive a signal from a ball carrying a ball communication element within a lace. The location of the ball is determined based upon the signal received by the plurality of playing area communication elements. Movement of the ball is calculated based upon the signal received by the plurality of playing area communication elements. The location and movement of the ball is communicated to a communication device which communicates ball movement and position.

According to a fifth exemplary aspect of the invention, a ball for use in a sport activity is provided. The ball comprises a thread on an outer surface of the ball, and a wire integrated within the thread. The wire is adapted to communicate a signal to a receiver so as to identify ball movement and position.

According to a sixth exemplary aspect of the invention, a method of identifying ball movement and position is also disclosed. The method includes placing a plurality of receivers on a playing surface, the plurality of receivers being adapted to receive a signal from a ball carrying a wire within the thread and adapted to transmit the signal. A location of the ball is determined based upon the signal received by the plurality of receivers and movement of the ball is calculated based upon the signal received by the plurality of receivers and application of external forces acting upon the ball. The location and movement of the ball are communicated to a display or other communication device to identify the ball position and movement for a user.

According to a seventh exemplary aspect of the invention, a system for identifying ball movement and position is also provided. The system includes a ball for use in a sport activity comprising a thread on an outer surface of the ball, and a wire integrated within the thread, the wire being adapted to communicate a signal to a receiver. A receiver is positioned near a playing area. The receiver is adapted to communicate a ball position based upon the signal received by the receiver. A processor is provided which is adapted to translate information received by the receiver into position and movement of the ball.

These and other features and advantages of various exemplary embodiments of systems, methods and devices according to this invention are described in, or are apparent from, the following detailed descriptions of various examples and embodiments of various devices, structures and/or methods according to this invention.

BRIEF DESCRIPTION OF DRAWINGS

Various examples of embodiments of the systems, devices, and methods according to this invention will be described in detail, with reference to the following figures, wherein.

Figure 1:
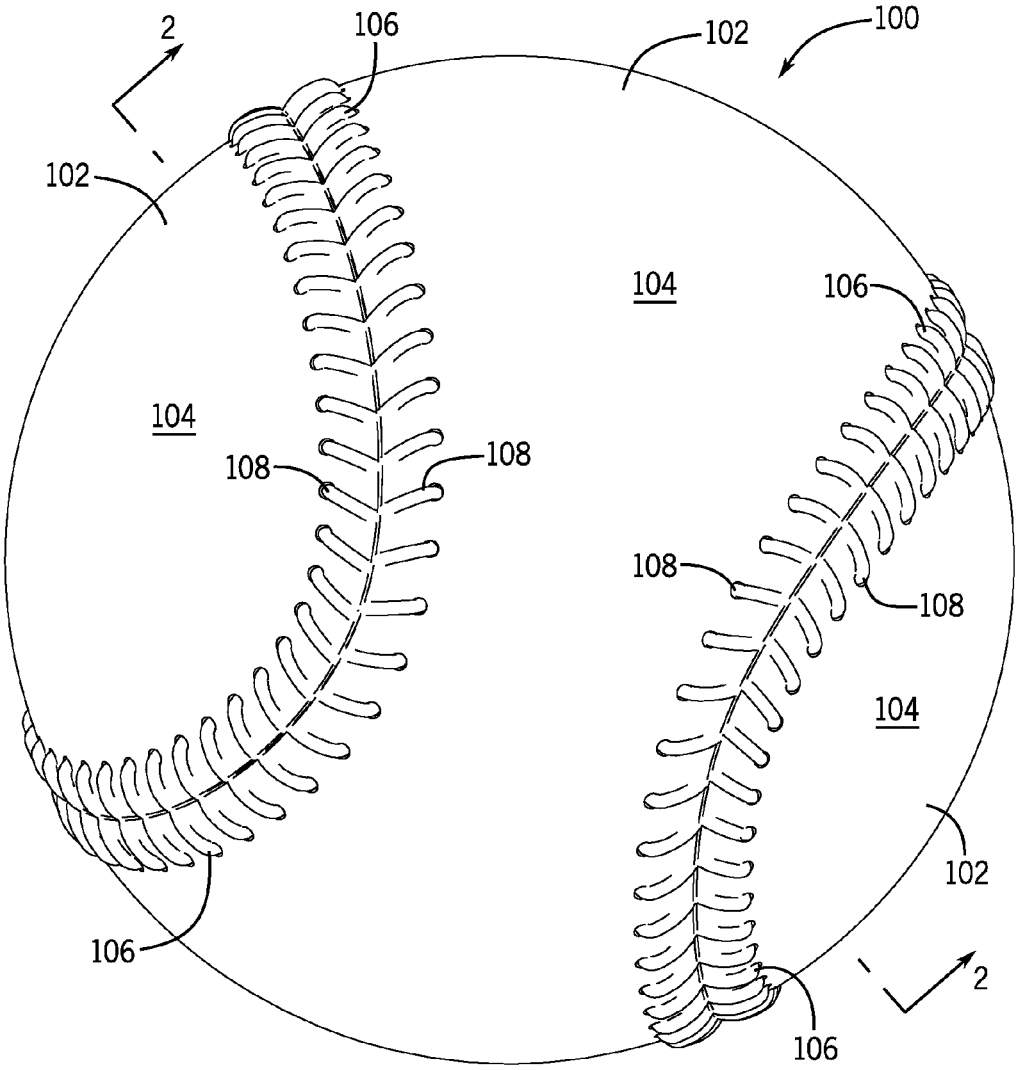
FIG. 1 is a perspective view of a ball according to one or more examples of embodiments for use with the system, method and devices for identifying ball movement and position described herein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Devices, methods and systems for identifying ball movement, trajectory and position are provided. The system generally includes a ball adapted to communicate with one or more playing area communication elements such as, for example, one or more transmitters and/or receivers. In one embodiment, for example, the method and system includes a ball adapted to communicate and/or receive a signal from one or more transmitters positioned, on, in, at, near and/or under a playing area. In another embodiment, a ball is adapted to communicate, send and/or transmit a signal to one or more receivers positioned, on, in, at, near and/or under a playing area. In other embodiments, the system includes a ball adapted to communicate with one or more transmitters and/or one or more receivers positioned, on, in, at, near and/or under a playing area.

In one embodiment, the playing area communication elements is/are adapted to communicate and/or identify and/or display ball position based upon the signal communicated or received. A processor or computer may be provided to translate and/or process information received by the playing area communication elements into position, movement of the ball and trajectory.

The ball may be any suitable ball having the properties described herein. In particular, the ball has an outer surface or cover and, in one or more examples of embodiments, includes a one or more laces or threads on or near, or partially on or near, the outer surface or cover of the ball. The one or more laces or threads may be on a portion of the outer surface or cover, may be partially embedded in the outer surface or cover, may be adjacent to the outer surface or cover, and/or may surround or substantially surround the outer surface or cover, or a portion thereof. Examples of balls typically having one or more laces or threads include, but are not limited to, a baseball, a football, a soccer ball, a cricket ball, and a volley ball. While a ball having one or more laces or threads is identified in one or more preferred examples of embodiments, the disclosure may be applied to and by alternative balls and objects for which position, movement and trajectory identification are desired.

As can be seen by reference to FIGS. 1-6, the outer surface of the ball may include an area with a ball communication element, such as a wire communication element, an antenna element, or some other type of electrical or magnetic communication or signaling element. In one or more examples of embodiments, the laces or threads of the ball carry the ball's communication element. However, the communication element may be included in a portion of the outer surface, or a surface covering, may be embedded below the outer surface, or may be disposed adjacent to the outer surface or cover of the ball. In the illustrated examples, the ball's communication element is a thin wire of varying diameter and length, and may be made of any suitable material for the purposes provided herein. For example, the wire may be formed of a material which may accept, induce or carry an electrical and/or magnetic charge and/or current. The charge or current may be detectable by one or more playing area communication elements such as one or more receivers.

Alternatively, a signal transmission device may be used in place of, or in connection with, the ball's communication element or wire. Such transmission devices may be disposed, partially or entirely, and without limitation, in the laces or threads of the ball, on the outer surface of the ball, adjacent to the outer surface of the ball, or may be embedded inside of the ball. Such transmission devices may include, without limitation, passive or active transmitters, passive or active transmitter-receivers and/or passive or active identification tags or devices such as, for example and without limitation, radio-frequency identification ("RFID") tags. For example, the communication element or wire may be in the form of, or connected to, a transmitter, which transmits a signal to another device, such as a receiver.

The ball's communication element or wire is durable, but semi-flexible in one or more embodiments such that it can be inserted, disposed, integrated and/or woven into the balls laces or threads. In other words, the communication element or wire may be integrated within the ball or embedded within the ball's laces or threads without affecting the integrity of the ball. In other examples of embodiments of the present invention, one or more of the ball's laces or threads, or a portion or part of the ball's laces or threads, such as one or more of the individual fibers or fiber threads that make up the laces or threads, is/are adapted or configured as the communication or signaling element or elements.

As previously mentioned, in one or more of the illustrated examples, the ball's communication element is a thin wire of varying diameter and length, and may be made of any suitable material for the purposes provided herein. For example, the wire may be formed of an electrically conductive material such as copper or some other type of metal. In other examples, the wire may be formed of other types of electrically or magnetically conductive materials. In yet other examples, the ball's communication element may be formed of any material which can accept, induce or carry an electrical or magnetic charge, current or signal. The charge, current or signal carried by the ball's communication element may be detectable by one or more playing area communication elements such as one or more receivers.

Figure 2:
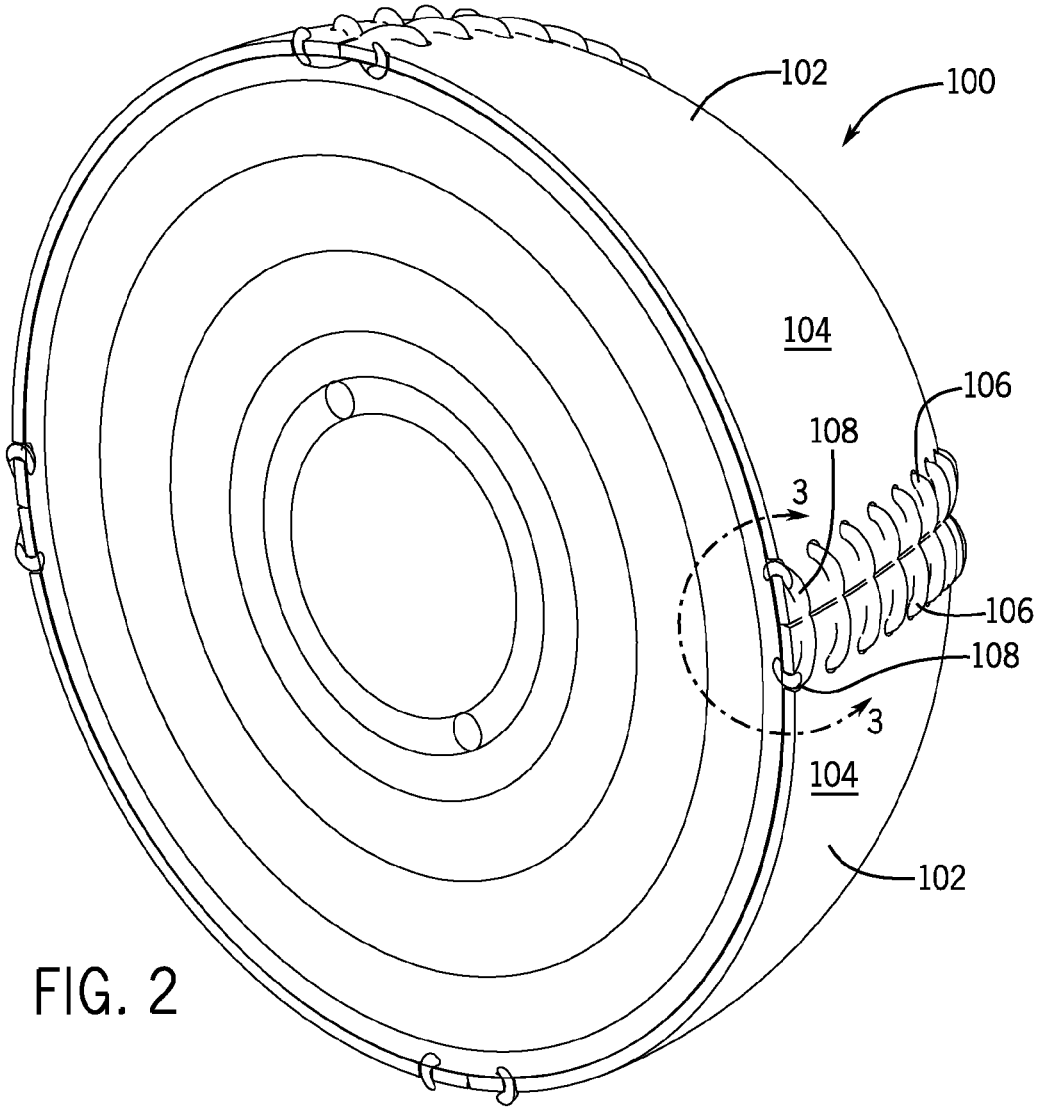
FIG. 2 is a cross-sectional view of the ball shown in FIG. 1, taken from line 2-2 of FIG. 1.
Figure 3:
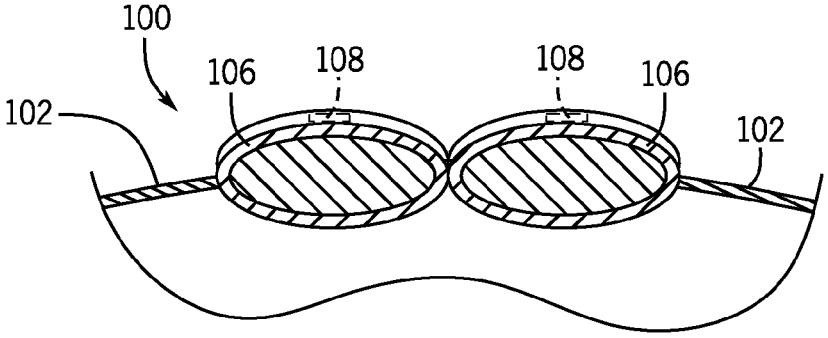
FIG. 3 is a section view of the ball shown in FIG. 1, taken from section 3-3 of FIG. 2, showing the ball laces or threads and ball communication element in one or more examples of embodiments of the system, method and devices for identifying ball movement and position.

A device or ball in accordance with one exemplary embodiment of the present invention is illustrated in FIGS. 1-3. More specifically, FIGS. 1-3 show a baseball 100 having a cover 102. Cover 102 constitutes the outer surface 104 of baseball 100. Cover 102 is attached to baseball 100 using one or more laces 106 (also referred to herein as threads or strings). Baseball 100 also includes one or more ball communication elements or antennas 108 in this exemplary embodiment of the present invention.

Figure 11:
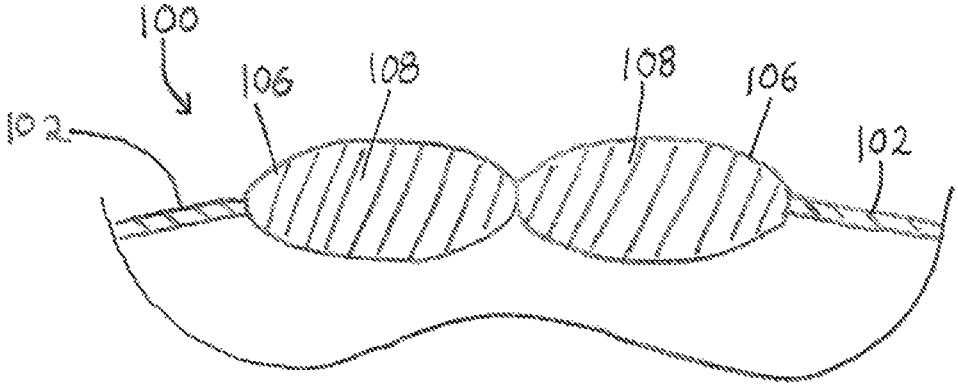
FIG. 11 is a cross-section view of one or more alternative examples of embodiments of a communication element taken along line 3-3 of FIG. 2, showing the lace or thread as a communication element.
Figure 12:
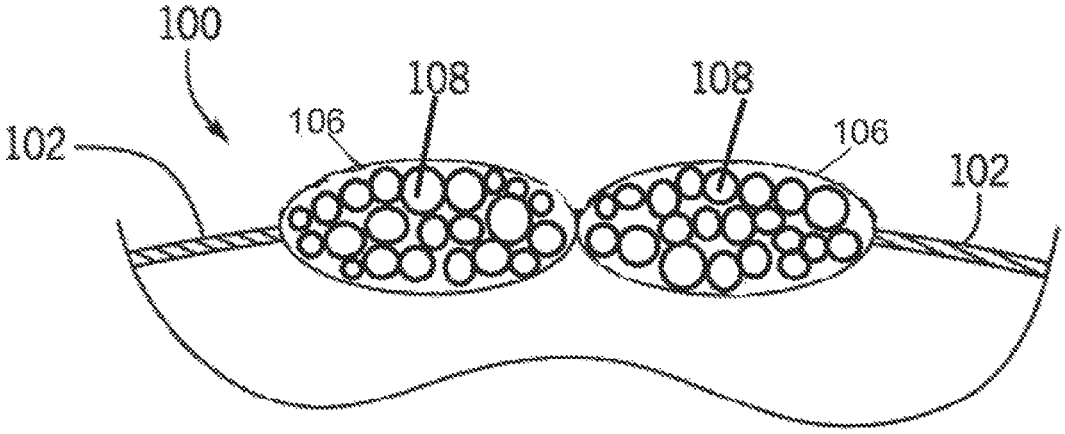
FIG. 12 is a cross-section view of one or more alternative examples of embodiments of a communication element taken along line 3-3 of FIG. 2, showing one or more threads as a communication element.

Communication element 108 in the exemplary embodiment of the present invention shown in FIGS. 1-3 is a separate wire antenna that is disposed inside of, and runs through, laces 106 of baseball 100. It should be noted that the present invention is not limited to simply having the communication element or antenna disposed inside of the laces of the ball as a separate element (see FIGS. 11-12). In other embodiments, for example, the ball's communication element is integrated with, or into, the laces such as, for example, when the communication element is woven into the laces (see FIG. 12). This might be the case, for example, where both electrically (or magnetically) conductive and non-electrically (or non-magnetically) conductive materials or fibers are used to create the laces. In other embodiments of the present invention, the laces of the ball is/are adapted or configured as the ball's communication element or the communication element and the laces is/are actually one and the same structure (see FIG. 11). This would be the case where, for example and without limitation, the laces are made entirely out of an electrically conductive (or magnetically conductive) material.

Communication elements 108 can be of varying lengths depending on the particular application. In one embodiment, for example, communication element 108 is very short and only extends inside of one of the exposed portions of lace 106 which are visible on the outer surface of ball 100. In other embodiments, communication element 108 is longer and is disposed inside of lace 106 such that it extends through several of the exposed portions of lace 106 which are visible on the outer surface of ball 100.

Figure 4:
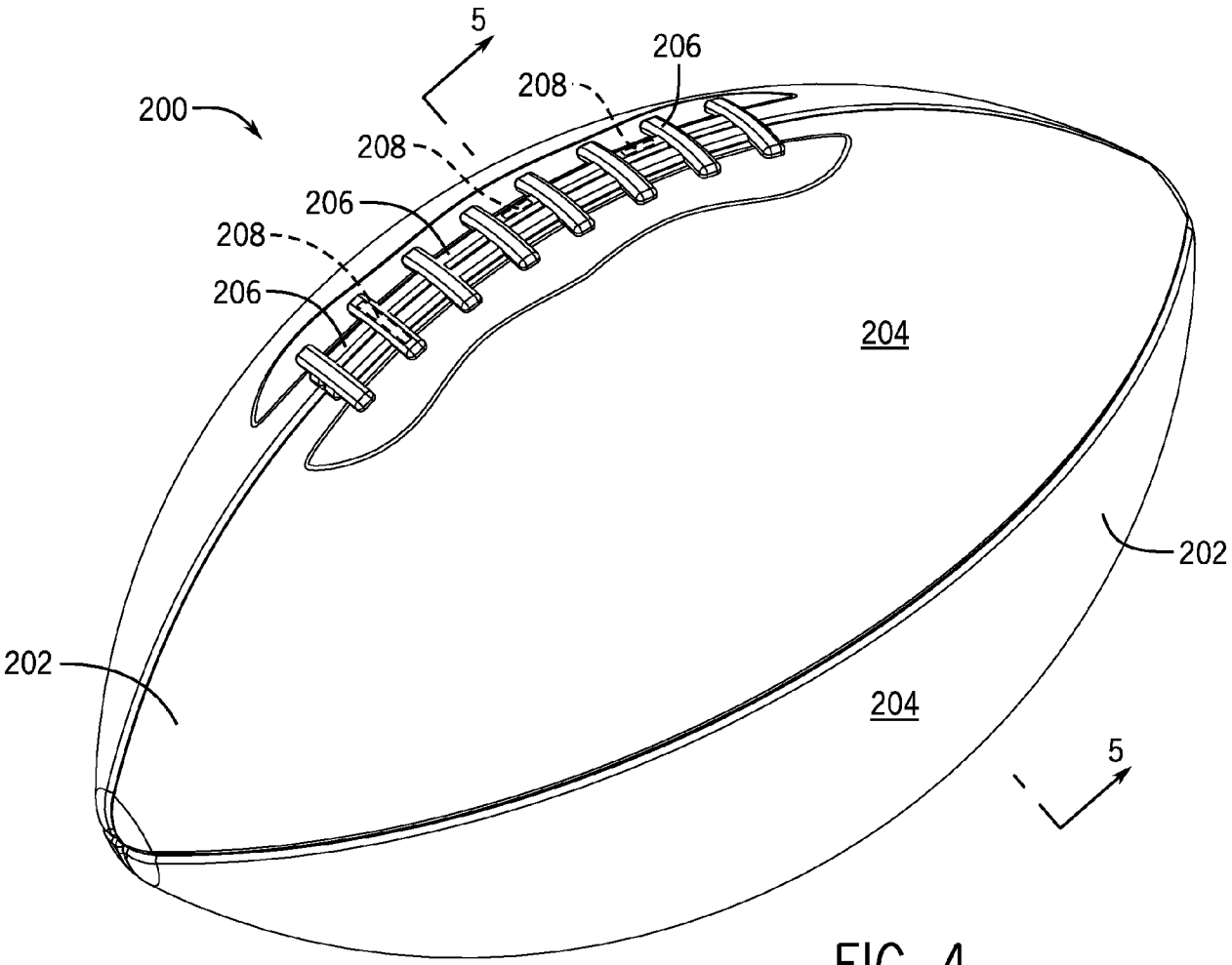
FIG. 4 is a perspective view of a ball according to one or more alternative examples of embodiments for use with the system, method and devices for identifying ball movement and position described herein.
Figure 5:
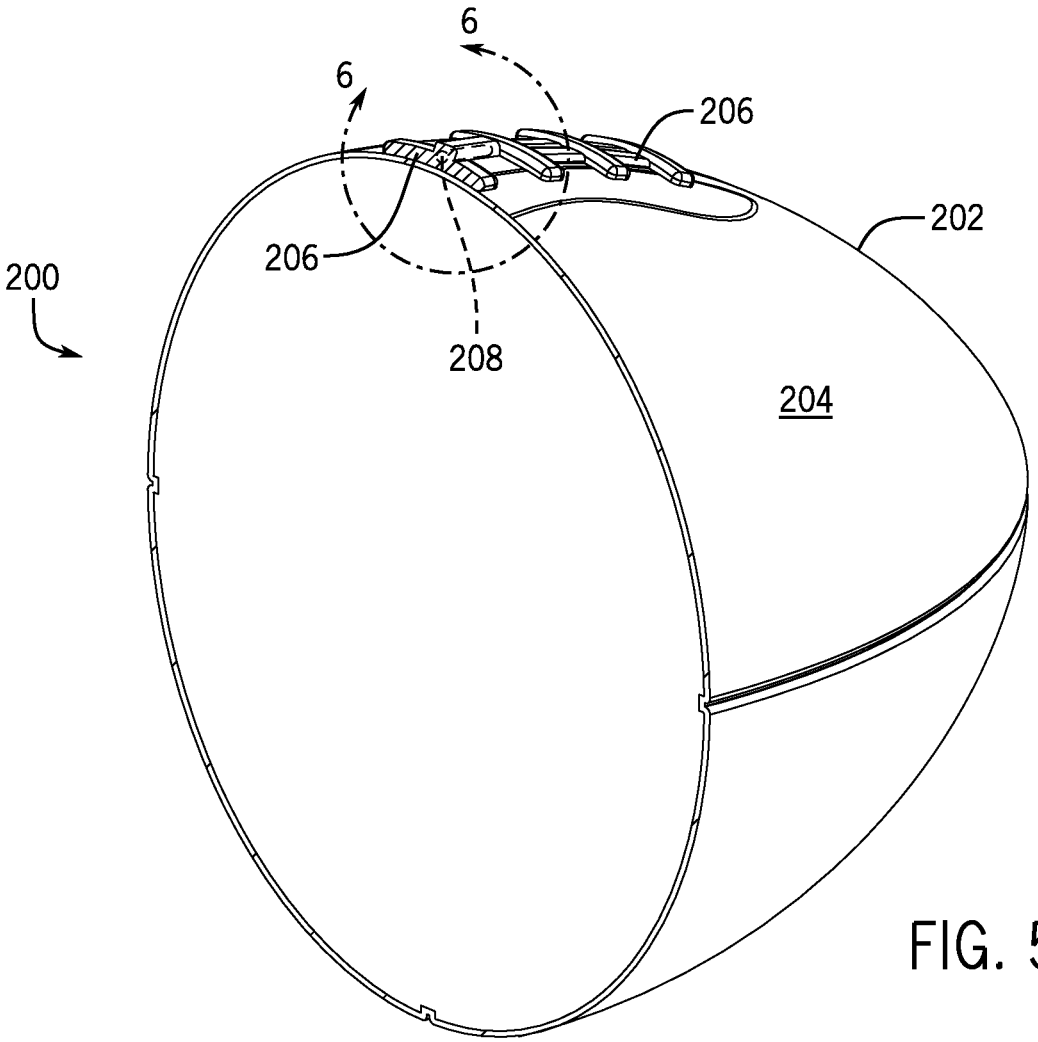
FIG. 5 is a cross-sectional view of the ball shown in FIG. 4, taken from line 5-5 of FIG. 4.
Figure 6:
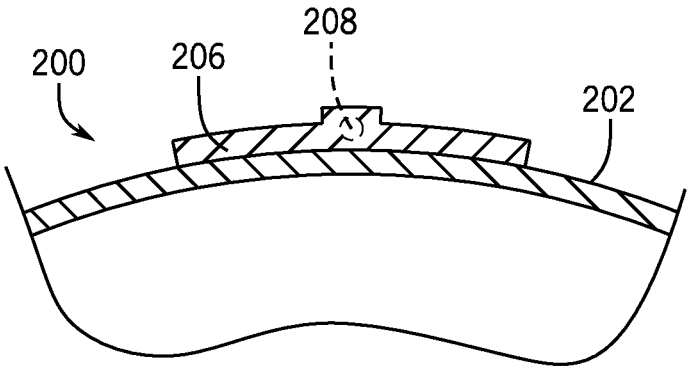
FIG. 6 is a section view of the ball shown in FIG. 4, taken from section 6-6 of FIG. 5, showing the ball laces or threads ball communication device in one or more examples of embodiments of the system, method and devices for identifying ball movement and position.

Another device or ball in accordance with an alternative exemplary embodiment of the present invention is illustrated in FIGS. 4-6. More specifically, FIGS. 4-6 show a typical American football 200 having a cover 202. Cover 202 constitutes the outer surface 204 of football 200 and is secured in place using laces 206 (again also referred to herein as threads or strings). Football 200, like baseball 100, also includes one or more communication elements or antennas 208 in this exemplary embodiment of the present invention. Communication elements 208 in the exemplary embodiment of the present invention shown in FIGS. 4-6 is/are also a wire antenna that is disposed inside, and runs through, laces 206 of football 200.

It should be noted that while a baseball and a football are specifically illustrated in FIGS. 1-6, the baseball and football are provided for purposes of example only, and any suitable ball, examples of which are previously described herein, may be acceptable for use in accordance with the present system, method and devices.

Figure 7:
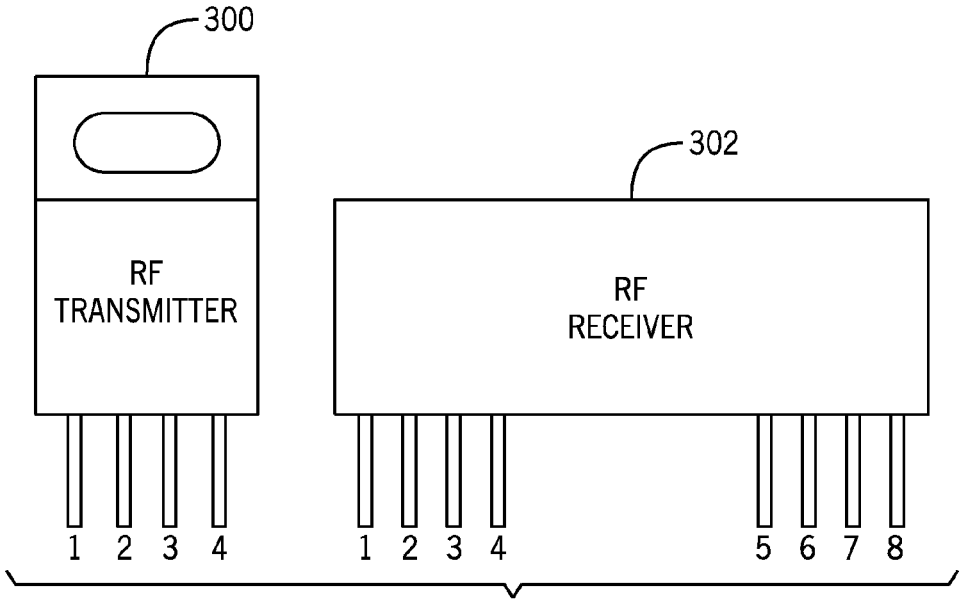
FIG. 7 shows playing area communication elements for use with one or more examples of embodiments of the system, method and devices for identifying ball movement and position described herein.

One or more playing area communication elements may be provided in association with the method and system. As used herein, a playing area communication element is any suitable device adapted to, or capable of, transmitting, sending, receiving and/or detecting a signal, typically an electrical or magnetic signal. The one or more playing area communication elements may be, for example, a transmitter 300 or a receiver 302, such as are shown in FIG. 7. The one or more transmitters 300 are any suitable device adapted to, or capable of, transmitting or sending a signal which can be received or detected by the communication element in the ball. The signal transmitted by the transmitter can also be used to energize a passive transmitter/receiver type device placed on, or embedded in, the ball such as, for example, a passive radio-frequency identification (RFID) tag or device. The one or more receivers 302 are any suitable devices adapted to, or capable of, receiving or detecting a signal communicated by or from the ball, and in particular, by or from the ball's communication element.

It should be understood that the methods and systems of the present invention are not limited to the use of only transmitters and receivers as the playing area communication elements. In other embodiments of the present invention, other types of playing area communication elements are utilized including transmitter-receivers, interrogators, readers and/or antennas of various sizes and configurations.

The one or more playing area communication elements may be positioned on, in, at, near, and/or under the playing area, and in particular at pre-defined positions on, in, at, near, and/or under the playing area. The playing area communication elements may be spaced apart and are provided at a distance and in a number suitable for transmission of, and/or receipt of, a signal to and/or from the ball's communication element. Any suitable arrangement accomplishing the purposes provided herein may be acceptable.

Figure 8:
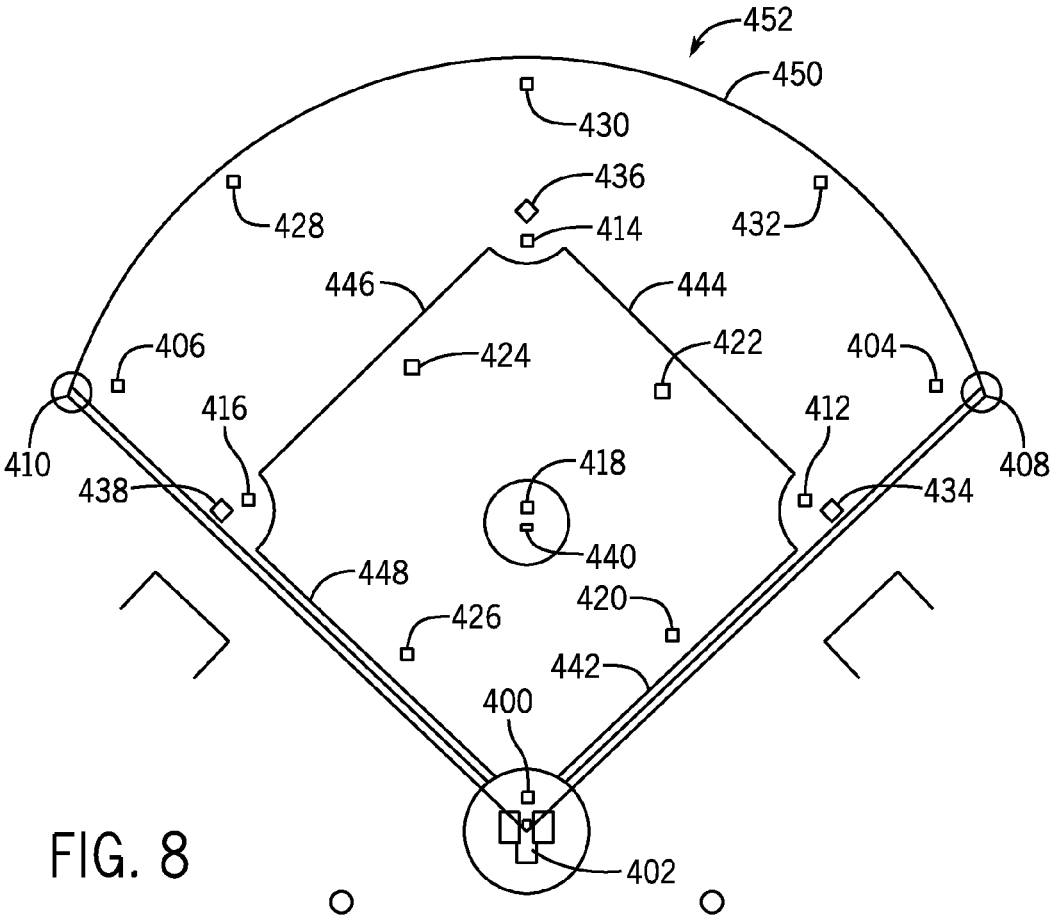
FIG. 8 is a playing area for use with one or more examples of embodiments of the system, method and devices for identifying ball movement and position described herein, showing a baseball field.

One or more examples of an arrangement for use with a playing area in the nature of a baseball field 452 are shown in FIG. 8. The baseball field or playing area may be provided with a plurality of playing area communication elements. The illustrated example shown in FIG. 8 will be described with the playing area communication elements being receivers. It should be understood, however, that although the method and system shown in FIG. 8 is illustrated using only receivers as the playing area communication elements, in other embodiments of the present invention, the system includes other types of playing area communication elements including, without limitation, transmitters, receivers, transmitter-receivers, interrogators, readers and/or antennas of various sizes and configurations.

As shown in FIG. 8, for example, a receiver 400 is positioned at, in, on, near, and/or below home plate 402. Receivers 404, 406 may also be positioned at, in, on, near, or below one or both foul poles or foul ball markers 408, 410. Optionally, receivers 412 through 430 may be respectively positioned at, in, on, near, and/or below first base 434, second base 436, third base 438, the pitching mound 440, the baselines 442, 444, 446, 448, and/or the outfield wall 450 in any combination and number. The receivers may be spaced apart and provided at predetermined distances. Additional locations may also be acceptable and are contemplated herein.

Figure 9:
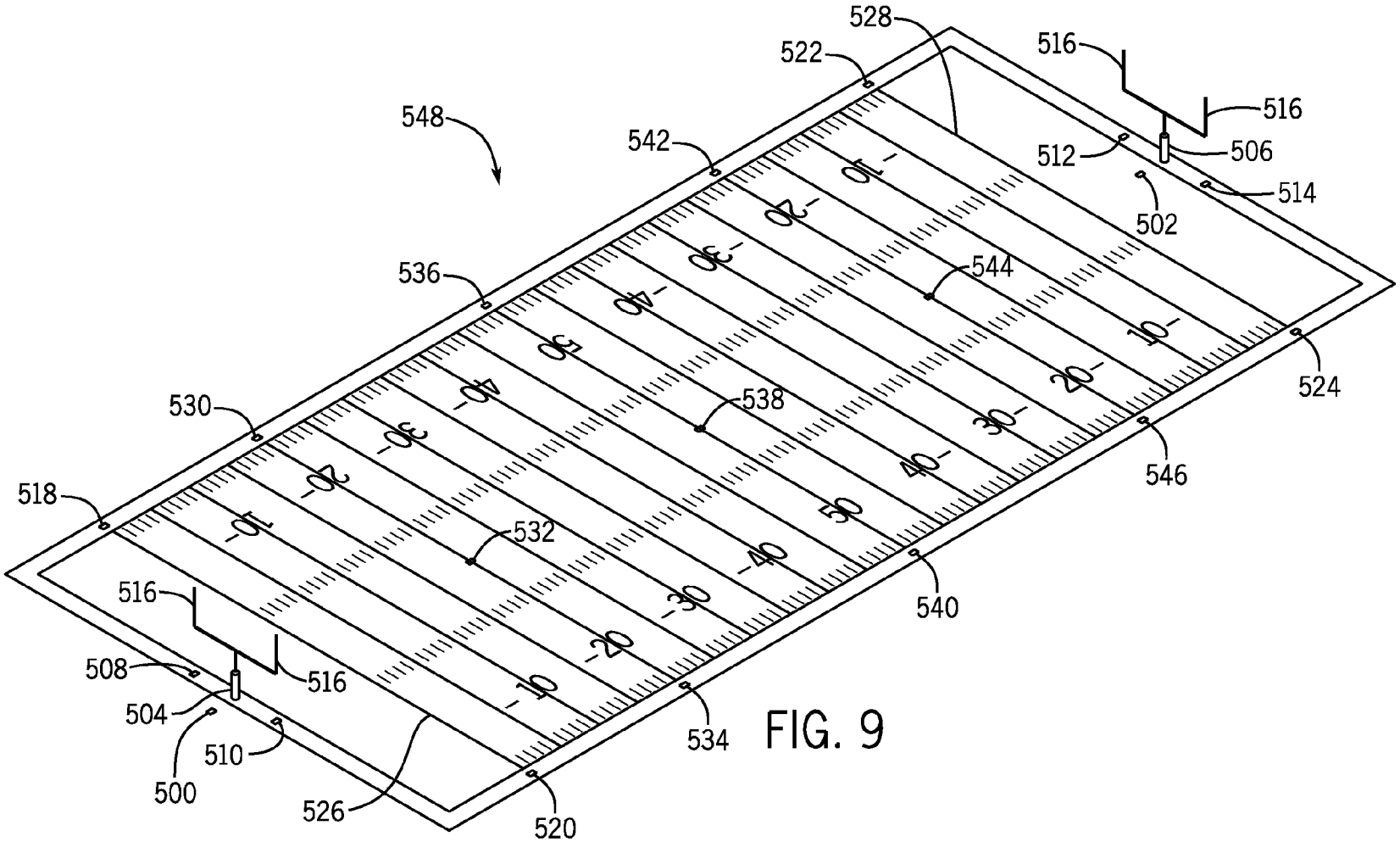
FIG. 9 is a playing area for use with one or more alternative examples of embodiments of the system, method and devices for identifying ball movement and position described herein, showing an "American football" field.

One or more examples of an arrangement for use with a playing area in the nature of a football field 548 are shown in FIG. 9. The football field or playing area may be provided with a plurality of playing area communication elements. The illustrated example shown in FIG. 9, like the baseball field in FIG. 8, will be described with the playing area communication elements being receivers. It should be understood, however, that although the method and system shown in FIG. 9 is illustrated using only transmitter-receivers as the playing area communication elements, in other embodiments of the present invention, the system includes other types of playing area communication elements including, without limitation, transmitters, receivers, transmitter-receivers, interrogators, readers and/or antennas of various sizes and configurations.

In the illustrated example, a receiver 500, 502 is positioned at, on, in, near, or under one or both goal posts 504, 506, and preferably a receiver 508, 510, 512, 514 is positioned so as to be aligned with each upright 516 of the goal posts 504, 506. In addition, one receiver or a plurality of receivers, such as for example a pair 518, 520 and 522, 524, may be positioned on, in, near, at or under one or both goal lines 526, 528. An additional one or more receivers 530 through 546 may optionally be positioned throughout, on, in, near, at and/or under the playing area in a variety of positions and locations. The receivers may be spaced apart and provided at predetermined distances.

A mechanism for providing a charge, or polarity, or current to the ball, and in particular, to the ball's communication element or antenna may also be provided. The mechanism may be any suitable device capable of delivering an electrical or magnetic charge or current or inducing an electrical or magnetic charge or current on, or in, the ball's communication element or antenna. In one or more examples, the charging device may be a transmitter embedded on, or in, the ball itself. The transmitter is connected or coupled to the ball's communication element or antenna disposed in the laces or strings of the ball. In another example, the charging device may be a remotely located (e.g., remote from the ball) device such as a transmitter, interrogator or reader positioned on or in the playing area.

In one or more additional examples, the charging device may be a contact-based system in which the ball or the ball's communication element is placed in contact with a charge or current delivery or charge or current inducing device. It is also contemplated that the charge or current delivery or charge or current inducing device may impart a charge or current to the ball remotely, that is, spaced from and not in direct contact with the ball or the ball's communication element. In one or more examples of embodiments, the charge or current inducing device comprises a ball rack which carries a charge or current delivery device or a charge or current inducing device. The ball rack may include an area capable of receiving a plurality of balls and charging said balls simultaneously. Alternatively, the ball rack may charge a single ball at a time and/or may contain an area for a single ball.

A computer system may be provided in association with one or more examples of embodiments of the present invention. The computer system may be in operable communication with the playing area communication elements (e.g., transmitters, receivers, etc. . . . ), and optionally the ball's communication element. The computer system may communicate wirelessly or via wire connection with the one or more playing area communication elements of the system. In one exemplary embodiment, the computer includes a communication device and/or software which is adapted to transmit output and/or receive input from the playing area communication elements and/or the ball or the ball's communication element. The processor or computer may therefore be provided in operable communication with the playing area communication elements and/or the ball or the ball's communication element, and is adapted to translate and or process information and/or signals received by the playing area communication elements into an identification of position and/or movement of the ball.

The computer system may be or include a processor. The computers for use with the various components and methods described herein may be programmable computers which may be special purpose computers or general purpose computers that execute the system according to relevant instructions. The computer system can be an embedded system, a personal computer, notebook computer, tablet computer, server computer, mainframe, networked computer, handheld computer, personal digital assistant, workstation, and the like. Other computer system configurations may also be acceptable including, cell phones, mobile devices, multiprocessor systems, microprocessor-based or programmable electronics, network PC's, minicomputers, and the like. Preferably, the computing system chosen includes a processor suitable in size to efficiently operate one or more of the various systems or functions described herein.

The system or portions thereof may also be linked to a distributed computing environment, where tasks are performed by remote processing devices that are linked through a communications network. To this end, the system may be configured or linked to multiple computers in a network, including, but not limited to a local area network, a wide area network, a wireless network, and the Internet. Therefore information and data may be transferred within the network or system by wireless means, by hardwire connection or combinations thereof.

The computer may also include a display, provision for data input and output, etc. Furthermore, the computer or computers may be operatively or functionally connected to one or more mass storage devices, such as, but not limited to a database. The memory storage can be volatile or non-volatile and can include removable storage media. The system may also include computer-readable media which may include any computer readable media or medium that may be used to carry or store desired program code or data that may be accessed by a computer. The system can also be embodied as computer readable code on a computer readable medium. To this end, the computer readable medium may be any data storage device that can store data which can be thereafter read by a computer system. Examples of computer readable medium include, without limitation, read-only memory, random-access memory, CD-ROM, CD-R, CD-RW, DVD, flash drives, thumb drives, magnetic tapes, and other optical and magnetic data storage devices. The computer readable medium can also be distributed over a network coupled computer system so that the computer readable code is stored and executed in a distributed fashion.

These devices include a graphical user interface (GUI) or a communication means by which commands may be entered and content or information may be displayed and/or communicated. For example, the computer may include a user interface that allows navigation of objects. The computer may implement or include an application that enables a user to display and interact with text, images, videos, data, and other information and content.

In one or more examples of embodiments the method or method embodied by software may be implemented by a computer system or in combination with a computer system. Aspects of the method described herein can be implemented on software running on a computer system. The system or method herein, therefore, may be operated by computer-executable instructions, such as but not limited to program modules, executable on a computer. Examples of program modules include, but are not limited to, routines, programs, objects, components, data structures and the like which perform particular tasks or implement particular instructions. The software system may also be operable for supporting the transfer of data and/or information within a network.

A display device may be provided in one or more examples of embodiments. The display device may be provided for viewing by an individual or by an audience. In one or more examples, the display device may be a portable viewing device which is carried by an official. The device may communicate a specific rule decision based upon ball movement, trajectory and/or position. The device may also communicate a specific ball location based upon the tracking technology. For example, a display device may be a pair of glasses which in the official's view illuminate a location for ball placement, such as a silhouette of a ball or a mark illustrating a ball location.

Figure 10:
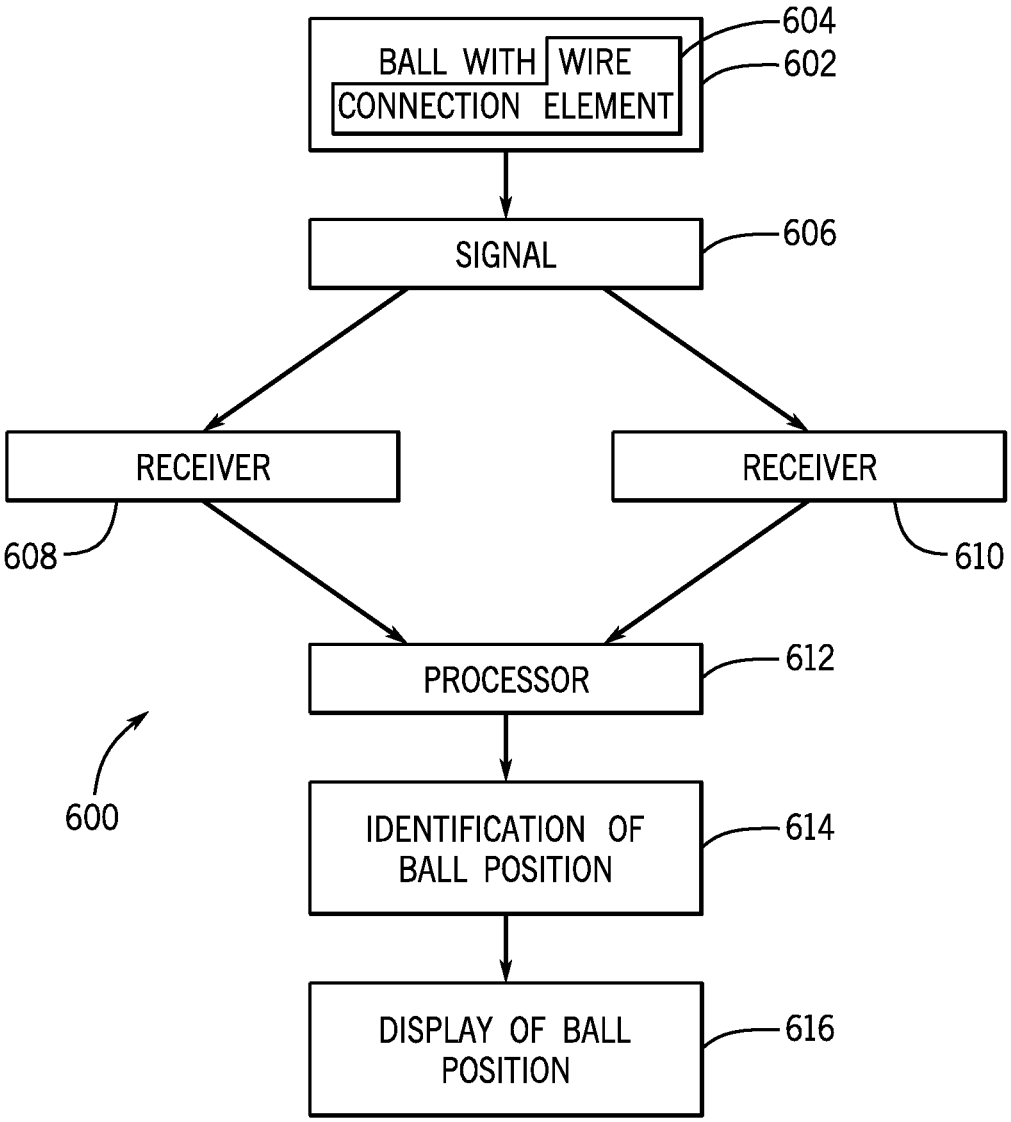
FIG. 10 is a flow chart illustrating one or more examples of the system, method and devices for identifying ball movement and position described herein.

A system for identifying ball movement and position includes one or more of the various components discussed herein. In one or more examples of embodiments, the system 600, such as identified in FIG. 10, includes a ball 602 having a connection or communication element 604. For example, a ball for use in a sport activity comprising one or more laces or threads on an outer surface of the ball may be provided. The ball may include a wire, an antenna, or some other communication element, disposed inside of, or integrated within, one or more of the laces or threads. The ball's communication element 604 is adapted or configured to communicate, receive or send a signal 606 to a playing area communication element, such as, for example, a receiver. The system, therefore, may also include one or more receivers 608, 610. The receivers may be positioned near a playing area or field. The receivers 608, 610 is/are adapted to receive the signal 606 from the ball's communication element 604 or otherwise communicate with the ball's communication element 604. A processor 612 or computer may be provided in operable communication with the receivers 608, 610 and/or the ball 602 or the ball's communication element 604 and is adapted to translate and/or process information received by the receivers 608, 610 and/or signal 606 into an identification 614 of position, trajectory and/or movement of ball 602. The system or processor or computer communicates the location, trajectory and/or movement of the ball to a display 616 or other communication device. In one or more examples of the system for identifying ball movement and position, a plurality of receivers are positioned at, in, on, near, or below the playing area.

The systems and devices herein may be implemented according to one or more methods. In one or more examples of embodiments, a method of identifying ball movement and position is provided. The method includes placing a plurality of playing area communication elements such as, for example, one or more transmitters, receivers, transmitter-receivers, interrogators, and/or readers in, on, near, or below a playing area or surface. The plurality of playing area communication elements are adapted to communicate, send, transmit, and/or receive a signal to and/or from a ball. The ball may carry a ball communication element such as, for example, a wire or antenna element, within one or more laces or threads which is/are adapted to communicate, send, transmit or receive the signal. The location of the ball is determined based upon the signal communicated and/or received by the plurality of playing area communication elements. Movement of the ball may also be determined or identified by calculating movement of the ball based upon the signal communicated and/or received by the plurality of playing area communication elements and application of external forces acting upon the ball. The system or processor or computer may communicate the location and movement of the ball to a display or other communication device. One or more algorithms may be applied to determine the movement and trajectory of the ball, as well as to apply any one or more external forces acting upon the ball.

The system and devices described herein provide various advantages over existing devices. For example, the system and devices are for use with a ball and corresponding playing area communication elements such as receivers which do not negatively impact or damage the integrity of the ball or the playing area. The system and devices for identification of ball movement and tracking identify, with precision, the location and movement of a ball in a playing area. The system and devices also provide a means by which an officiator may receive real-time accurate information to assist in decision making. These and other objects and advantages will be apparent from the foregoing description and appended claims.

EXAMPLES

The following Examples are an illustration of one or more examples of embodiments of carrying out the invention and are not intended as to limit the scope of the invention:

Example 1

The tracking method and system according to one or more examples of embodiments provides a mechanism to accurately manage or officiate game play and provides a means or a backstop for judgment calls by officials. One example provided herein, and illustrated in Table 1, is "American rules" football.

TABLE 1

Application of System to Common Disputed Sports Official Violations (American Rules Football)

| No. | Type Disputed Call | Tracking Technology Assistance | Ref |
|---|---|---|---|
| 1 | Close Spotting of the Ball for Downs | Supplements close measurements by chains.<br>Helps chains be moved to correct location on each down.<br>Helps ensure that referees do not incorrectly place ball.<br>In rare cases where referees lose track of ball, helps spot ball at correct location.<br>Correct spotting of ball in bad weather situations, e.g., snow, mud makes seeing field marking difficult or impossible.<br>Ensure referees award correct yardage gains. | FB-1,<br>FB-3,<br>FB-5,<br>FB-6,<br>FB-15 |
| 2 | Offsides/False Starts | Proves scrimmage line when offsides & false starts occur. | FB-2 |
| 3 | Ball Behind Line of Scrimmage | Tracks ball location in chaotic situations where it is difficult or near impossible for referees to keep track of ball. Proof of ball behind line of scrimmage, for example. | FB-7 |
| 4 | Out of Bounds Incorrect Calls/Disputes | Provide certainty on forward passes or carries where ball went out of bounds and exact location. | FB-8,<br>FB-12 |
| 5 | Forward passes over line of scrimmage | Confirmation if quarterbacks made forward passes behind or over line of scrimmage. | FB-9 |
| 6 | Pass Completions | Time stamp from ball tracking and video replay can determine length of possession by receiver allowing correct completion calls. | FB-10 |
| 7 | Ball Hits Ground | Confirmation if ball touches ground, assisting in calling dead balls, whether forward passes were legitimately completed, etc. | FB-11 |
| 8 | Whether Receiver/Ball Carrier in End Zone Sufficient for Touchdown | Tracking technology provides precise ball location but also reference information for calls regarding the exact location of player, for example, were players feet inside the end zone for TD? | FB-13 |
| 9 | Calling forward pass vs. lateral pass | Referees could judge angle and direction of passes that are near perpendicular to field, calling lateral or forward pass, and if player catching ball is an eligible receiver. | FB-14 |
| 10 | Spotting Ball After Fumbles | Assists referees in spotting ball after player recovers.<br>Prevents players from "fudging" ball locations when there is a "pile on" where referee loses track of ball.<br>Correctly spot ball in ambiguous situations, such as double fumbles.<br>Calling correct yard line when fumbled football out of bounds. | FB-16,<br>FB-17,<br>FB-18 |
| 11 | Illegal punts | If punter drops ball and punts ball off ground, proof that ball hit ground and punt was illegal. | FB-18 |
| 12 | Tipped punts | Determine sudden change in ball trajectory of punt if tipped. | |
| 13 | Shanked punts out of bounds | Determine where a shanked punt goes out of bounds. | |
| 14 | Intentional grounding | Determine if ball was close enough to eligible receiver(s) downfield or forward pass was intentional grounding. | FB-19 |
| 15 | Dead football | Correct spotting of dead football.<br>Assists in very close or controversial calls, such as whether ball on goal line was just on line or in the end zone. | FB-20 |
| 16 | Possession of the Football | After ball blown dead, determine correct possession after 4th down kicks and recoveries. | FB-21 |
| 17 | Calling close goal line touchdowns | Determine whether ball is sufficiently over the goal line for TDs to be correctly called. | FB-23 |
| 18 | NCAA Rule—Determining whether receiver leaned in or out over end zone lines when catching football | Exact location of football relative to end zone lines. | FB-24 |
| 19 | Sufficient receiver possession in end zone for TD | Exact length of possession can be determined to make the correct call. | FB-25 |
| 20 | Pass Interference | Did defender hit receiver before or after ball arrives?<br>Defender batt down ball or pass interference?<br>Was it a good catch in bounds "on top of " bounds line when defender then pushes receiver out of bounds? | FB-26,<br>FB-27,<br>FB-28 |

TABLE 1-continued

| Application of System to Common Disputed Sports Official Violations (American Rules Football) | | |
|---|---|---|
| No. Type Disputed Call | Tracking Technology Assistance | Ref |
| 21 Onside Kicks | Determining whether offsides actually occurred in often ambiguous situations such as onside kicks. | FB-29 |
| 22 The "Tuck Rule" | When QBs are under extreme tackler pressure, they often drop balls. Sometimes it looks like they were going to make a forward pass, but actually fumble. Motion of ball in such situations would help in making correct calls. | FB-30 |
| 23 Grounded ball or ball hitting defensive or offensive players | If tracking technology had been available, Raiders-Steelers 1972 AFC playoff "Immaculate Reception" play could have been called with no doubts about what actually happened. Video did not reveal ball's trajectory. | FB-31 |
| 24 NCAA Rules "Taunting" | Did TD-scoring player "taunt" the opposition when in end zone? New 2011 season rule (see If this occurs before crossing goal line, it is not a penalty. | |

As can be seen by reference to Table 1, numerous rules and corrections can be addressed by the present invention.

Example 2

The tracking methods, systems and devices according to one or more examples of embodiments provides more and more accurate statistics at both the individual level, an Example of which is illustrated in Table 2, and at the team level, an Example of which is illustrated in Table 3. Such statistical accuracy provides various advantages to coaches and teams, as well as the fantasy sports market which bases game play on individual and team statistics.

TABLE 2

| Individual Statistics (American Rules Football) More Accurate & New Statistics[1] INDIVIDUAL PLAYER STATISTICS | | |
|---|---|---|
| | Tracking Technology Assistance | |
| No. Type of Statistic | More accurate statistics | New statistics |
| 1 Passing Yards (QBs) | Accurate measurement of yards traveled by ball. | Actual distance traveled by ball over parabolic trajectory.<br>Height achieved by football during forward pass.<br>Based on timestamps, average speed achieved by football. |
| 2 Incomplete Passes (QBs) (Useful for post-game analyses of QB attempts) | Accurate measurement of yards traveled by ball, even if pass is not completed | Actual distance traveled by ball over parabolic trajectory.<br>Height achieved by football during forward pass attempts.<br>Based on timestamps, average speed achieved by football. |
| 3 Receiving Yards (Receivers) | Accurate measurement of net yardage traveled by football to receiver. | Actual distance traveled by ball over parabolic trajectory.<br>Height achieved by football during forward pass.<br>Based on timestamps, average speed achieved by football. |
| 4 Rushing Yards—Offense | Accurate measurement of net yardage gained by ball carrier. | Actual "on ground" distance traveled by ball carrier as he scrambles forward to gain yardage.<br>Ratio of yards gained vs. actual distance "on ground" covered by scrambling of ball carrier.<br>Average speed of scramble by ball carrier on ground, and average speed of the net yardage gained in the play. |
| 5 Rushing Yards—Defense | None directly related to movement of footballs. | Can closely quantify distances traveled "on ground" by tacklers during defensive plays<br>Ratio of distances traveled by defenders relative to yards gained by offense, or lost, by offense in |
| 6 Fumbles | N.A. | "On ground" distance actually traveled by football after fumble.<br>Ratio of on-ground distance traveled by ball vs. yards gained |

TABLE 2-continued

| Individual Statistics (American Rules Football) More Accurate & New Statistics[1] INDIVIDUAL PLAYER STATISTICS | | |
|---|---|---|
| | Tracking Technology Assistance | |
| No. Type of Statistic | More accurate statistics | New statistics |
| | | by successful defensive recovery. Ratio of on-ground distance traveled by football vs. yards gained, or lost, by successful offensive recovery. |
| 7 Kicking and Punting | Accurate measurement of net yardage traveled by football to other team receiver. | Actual distance traveled by ball over parabolic trajectory. Height achieved by football during kick or punt. Based on timestamps, average speed achieved by football. |
| 8 Kick and Punt Returns | Accurate measurement of net yards gained by kick and punt returns. | Accurately determine "on ground" distance traveled by kick and punt returners while running/scrambling. Ratio of on-ground distances traveled by kick and punt returners relative to net yards gained in return. Average speed of kick and punt returners on ground, and average speed net yards gained. |

[1]Primary statistics covered by http://www.pro-football-reference.com

TABLE 3

| Team Statistics (American Rules Football) More Accurate & New Statistics[2] COLLECTIVE TEAM STATISTICS | | |
|---|---|---|
| | Tracking Technology Assistance | |
| No. Type of Statistic | More accurate statistics | New statistics |
| 9 Passing Yards (QBs) | Accurate measurement of yards traveled by ball. | Collective team totals of player statistics noted in first section. |
| 10 Incomplete Passes (QBs) (Useful for post-game analyses of QB attempts) | Accurate measurement of yards traveled by ball, even if pass is not completed. | Collective team totals of player statistics noted in first section. |
| 11 Receiving Yards (Receivers) | Accurate measurement of net yardage traveled by football to receiver. | Collective team totals of player statistics noted in first section. |
| 12 Rushing Yards—Offense | Accurate measurement of net yardage gained by ball carrier. | Collective team totals of player statistics noted in first section. |
| 13 Rushing Yards—Defense | None directly related to movement of footballs. | Collective team totals of player statistics noted in first section. |
| 14 Fumbles | N.A. | Collective team totals of player statistics noted in first section. |
| 15 Kicking and Punting | Accurate measurement of net yardage traveled by football to other team receiver. | Collective team totals of player statistics noted in first section. |
| 16 Kick and Punt Returns | Accurate measurement of net yards gained by kick and punt returns. | Collective team totals of player statistics noted in first section. |

[2]Primary statistics covered by http://www.pro-football-reference.com

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The invention claimed is:

1. A laced ball for use in a sport activity, the ball comprising:

a lace comprising one or more threads, the lace woven into the ball outer surface; and wherein the one or more threads are a communication element comprising a receiver, processor, transmitter and antenna, and wherein the communication element is adapted to communicate a signal.

2. The ball of claim 1 further including an outer surface, wherein a portion of the lace is disposed on the outer surface, and further wherein the communication element is disposed inside of the portion of the lace which is disposed on the outer surface.

3. The ball of claim 1 further including an outer surface, wherein a portion of the lace is disposed adjacent to the outer surface, and further wherein the communication element is disposed inside of the portion of the lace which is disposed adjacent to the outer surface.

4. The ball of claim 1 wherein the communication element is a wire communication element.

5. The ball of claim 1 wherein the communication element is an electrically conductive element.

6. The ball of claim 1 wherein the lace is comprised of a plurality of thread fibers and at least one of the thread fibers is the communication element.

7. The ball of claim 1 wherein the ball is selected from the group consisting of a baseball, a football, a soccer ball, a cricket ball, and a volley ball.

8. The ball of claim 1 wherein the signal is an electrical signal.

9. The ball of claim 1 wherein the signal is a magnetic signal.

10. A system for identifying movement and position of balls on, in, within and/or around a sport playing area, the system comprising:

a laced ball for use in a sport activity, wherein the laced ball has an outer surface, a lace comprising one or more threads threads disposed adjacent to the outer surface and comprising a ball communication element which is a receiver, processor, transmitter, and antenna, which communication element is formed of the one or more threads, wherein the ball communication element is adapted to communicate a signal; and at least one playing area communication element positioned near the playing area, wherein the at least one playing area communication element is adapted to communicate with the ball communication element via the signal.

11. The system of claim 10 wherein the at least one playing area communication element is a receiver adapted to receive the signal from the ball communication element.

12. The system of claim 10 wherein the ball includes a radio-frequency identification tag coupled to the ball communication element.

13. A system for identifying movement and position of balls on, in, within and/or around a sport playing area, the system comprising:

a laced ball for use in a sport activity, wherein the ball has an outer surface, a lace disposed adjacent to the outer surface and comprising one or more threads forming a ball communication element comprising a receiver, processor, transmitter, and antenna, wherein the ball communication element is adapted to communicate a signal;

a playing area communication element positioned near the playing area, the playing area communication element adapted to communicate ball position based upon the signal received by the playing area communication element from the ball communication element; and an additional processor in communication with the ball communication element and laying area communication element, the additional processor adapted to process ball position information received by the playing area communication element into position and movement of the ball.

* * * * *

UNITED STATES PATENT AND TRADEMARK OFFICE

CERTIFICATE OF CORRECTION

PATENT NO. : 9,242,150 B2
APPLICATION NO. : 14/201271
DATED : January 26, 2016
INVENTOR(S) : Gale It is certified that error appears in the above-identified patent and that said Letters Patent is hereby corrected as shown below:

In the claims,
In Column 18, Line 23, in Claim 10, delete "threads threads" and insert -- threads --, therefor.

Signed and Sealed this
Ninth Day of August, 2016

Michelle K. Lee

Michelle K. Lee
*Director of the United States Patent and Trademark Office*